US006806840B2

(12) United States Patent
Hung et al.

(10) Patent No.: US 6,806,840 B2
(45) Date of Patent: Oct. 19, 2004

(54) PATCH ANTENNA AND APPLICATION THEREOF

(75) Inventors: Pai-Fu Hung, Tainan (TW); Ren-Horng You, Tainan (TW); Feng-Hsueh Wang, Kaohsiung (TW)

(73) Assignee: Accton Technology Corporation (TW)

( * ) Notice: Subject to any disclaimer, the term of this patent is extended or adjusted under 35 U.S.C. 154(b) by 2 days.

(21) Appl. No.: 10/305,186

(22) Filed: Nov. 27, 2002

(65) Prior Publication Data

US 2004/0100404 A1 May 27, 2004

(51) Int. Cl.[7] ..... H01Q 9/00

(52) U.S. Cl. ..... 343/752; 343/700 MS; 343/702

(58) Field of Search ..... 343/700 MS, 702, 343/749, 751, 752, 829, 847, 848, 893, 878, 879

(56) References Cited

U.S. PATENT DOCUMENTS 4,443,803 A * 4/1984 DeSantis et al. ..... 343/749
5,181,044 A * 1/1993 Matsumoto et al. ..... 343/752
5,243,353 A * 9/1993 Nakahara et al. .... 343/700 MS
6,563,468 B2 * 5/2003 Hill et al. ..... 343/741

* cited by examiner

*Primary Examiner*—Shih-Chao Chen

(57) ABSTRACT

A patch antenna and the related applications are disclosed. The patch antenna includes a radiating metal plate; a metal supporting plate; and a metal fixed plate, wherein the radiating metal plate is round shape with a stripe-shape opening. When the patch antenna is operated at 5.25 GHz, good radiation pattern and antenna gain are provided to cover the bandwidth utilized in Industrial-Scientific-Medical (ISM) band. Moreover, the present invention uses the arrangement of antenna diversity to install two antennas on a base board at the same time, thereby obtaining better antenna performance.

18 Claims, 9 Drawing Sheets x-z plane x-y plane

PATCH ANTENNA AND APPLICATION THEREOF

FIELD OF THE INVENTION

The present invention relates to a patch antenna and the applications thereof, and more particularly, to the patch antenna using a circular radiating metal plate having an opening, and to the wireless network apparatus applying the patch antenna.

BACKGROUND OF THE INVENTION

With the advancement of communication technologies, the applications using communication technologies have also increased significantly, thus making the related products more diversified. Especially, consumers have more demands on advanced functions from communication applications, so that many communication applications with different designs and functions have been continuously appearing in the market, wherein the computer network products with wireless communication functions are the main streams recently. Moreover, with integrated circuit (IC) technologies getting matured, the size of product has been gradually developed toward smallness, thinness, shortness and lightness.

An antenna in the communication products is an element mainly used for radiating or receiving signals, and the antennas used in the current wireless products have to own the features of small size, excellent performance and low cost, so as to be broadly accepted and confirmed by the market. According to the locations where antennas are mounted, the antennas can be classified into two categories, which are a built-in type and an external type. For the sake of appearance and convenient utilization, the built-in typed antennas have gradually replaced the external-typed antennas. On the other hand, the surface mount technology (SMT) that is suitable for use in mass production has been quite matured. Hence, applying the surface mounting technology in installing antennas can greatly reduce the cost for packaging and connecting the same, so that the surface mounting technology has become one of the most popular design methods for the built-in type antennas.

According to different operation requirements, the functions equipped in the communication products are not all the same, and thus there are many varieties of antenna designs used for radiating or receiving signals, wherein a patch antenna is quite commonly used. In order to obtain an antenna with high gain and broadband operation, the distance between the base board and the radiating metal plate can be increased for promoting the radiation efficiency and the operation bandwidth of the antenna. Generally, the features of antenna can be known by the parameters of operation frequency, radiation pattern, return loss, and antenna gain, etc. Hence, the design of patch antenna has to simultaneously consider the factors of appropriate distance between the base board and the radiating metal plate, and good antenna features.

However, it is very difficult for the conventional patch antenna to simultaneously have the advantages of low cost, small size, high antenna gain, broad operation bandwidth and good radiation pattern, and also not easy to match the design of the housing mechanism, so that the applications of the conventional patch antenna are greatly limited. Moreover, the conventional patch antenna has larger second harmonic, which will cause electromagnetic interference (EMI).

Hence, there is an urgent need to develop a patch antenna for satisfactorily meeting the antenna requirements of small size, high gain, wide broadband, simple design, low cost and small second harmonic, etc., thereby overcoming the disadvantages of the conventional patch antenna.

SUMMARY OF THE INVENTION

In view of the invention background described above, since the conventional patch antenna cannot effectively satisfy the aforementioned antenna requirements; is not easy to match the design of housing mechanism; and has larger second harmonic, the applications thereof are thus greatly limited.

It is the principal object of the present invention to provide a patch antenna and the apparatuses using the patch antenna, thereby providing the antenna with smallness, thinness, shortness and lightness, wherein the surface mount technology can be used to install the antenna on a base board, so that mass production can be performed, and the product stability can be enhanced. The present invention further provides the patch antenna having smaller second harmonic for avoiding causing EMI.

It is the other object of the present invention to provide a patch antenna and the application systems thereof, for obtaining better antenna performance by simultaneously installing two antennas on a base board via the arrangement of antenna diversity.

In accordance with the aforementioned objects of the present invention, the present invention provides a patch antenna, wherein the antenna comprises: a base board, wherein a coated ground plane is formed on the lower surface of the base board; a radiating metal plate, which is a round plate having an opening; a metal supporting plate, of which one end is electrically connected to one side of the opening of the radiating metal plate and a feeding point is formed thereon, wherein the aforementioned side of the opening is not parallel to the other sides of the opening; a metal fixed plate, wherein one end of the metal fixed plate is electrically connected to the other end of the metal supporting plate, and the metal fixed plate is electrically installed on the base board; wherein there is a predetermined distance maintained between the base board and the radiating metal plate.

Further, the present invention provides a wireless network apparatus, wherein the wireless network apparatus comprises: a base board, having a radio frequency (RF) device, and the radio frequency device has an antenna output terminal used for transmitting signals between the radio frequency device and a wireless system, and a coated ground plane is formed on the lower surface of the base board; a first patch antenna, wherein the first patch antenna comprises: a first radiating metal plate, which is a round plate having a first opening; a first metal supporting plate, of which one end is electrically connected to one side of the first opening and a first feeding point is formed thereon, wherein the aforementioned side of the first opening is not parallel to the other sides of the first opening; a first metal fixed plate, wherein one end of the first metal fixed plate is electrically connected to the other end of the first supporting plate, and the first metal fixed plate is electrically installed on the antenna output terminal; wherein there is a first predetermined distance between the base board and the first radiating metal plate; and a second patch antenna, wherein the second patch antenna comprises: a second radiating metal plate, which is a round plate having a second opening; a second metal supporting plate, of which one end is electrically connected to one side of the second opening and a second feeding point is formed thereon, wherein the aforementioned side of the second opening is not parallel to the other sides of the second opening; a second metal fixed plate, wherein one end of the second metal fixed plate is electrically connected to the other end of the second supporting plate, and the second metal fixed plate is electrically installed on the antenna output terminal; wherein there is a second predetermined distance between the base board and the second radiating metal plate. Further, the wireless network apparatus comprises a housing having a convex hollow portion used for accommodating the base board to form a wireless network card.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
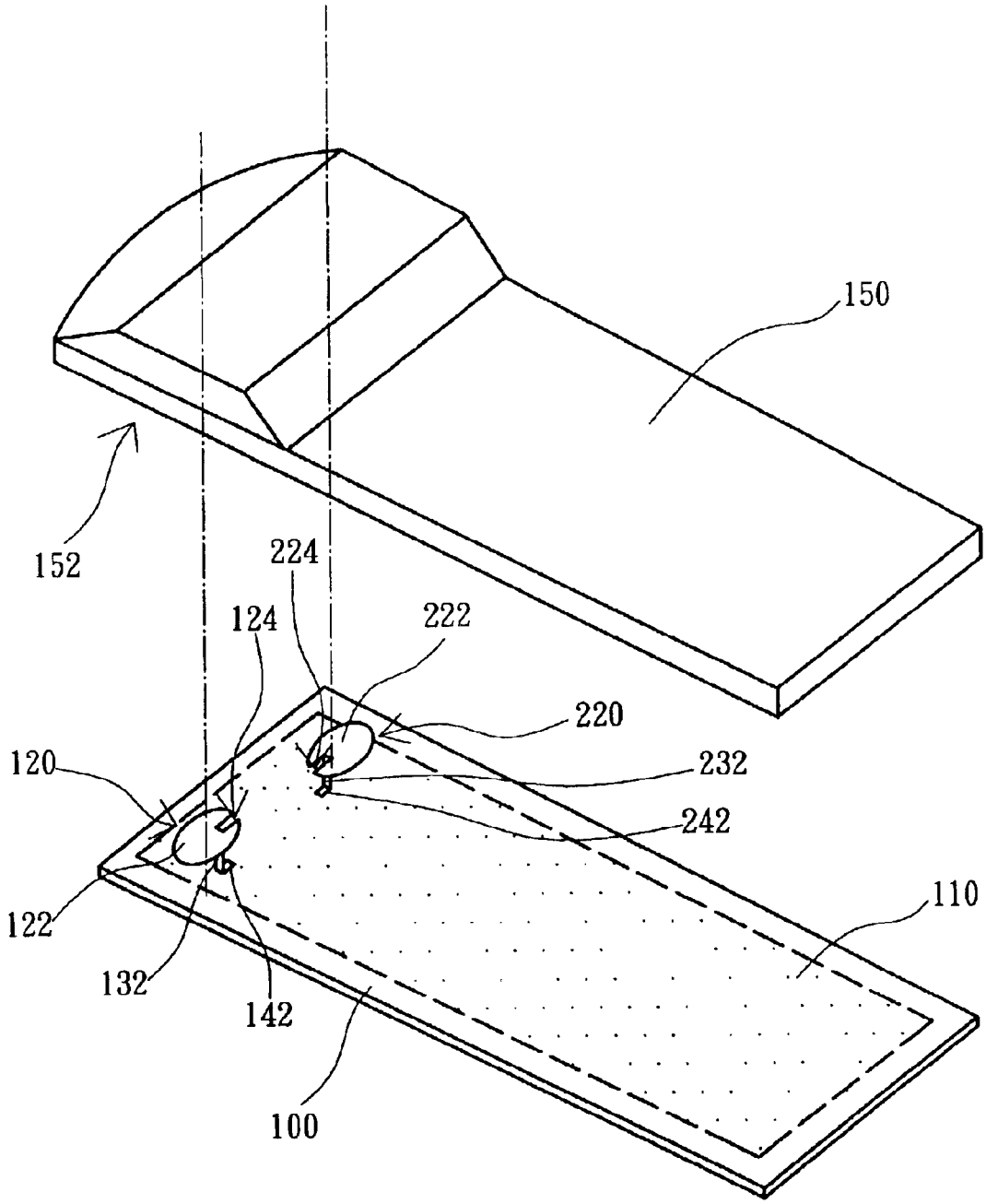
FIG. 1 is a 3-D schematic diagram showing the assembly of a patch antenna and an actual application product, according to a preferred embodiment of the present invention.

Referring to FIG. 1, FIG. 1 is a 3-D schematic diagram showing the assembly of a patch antenna and an actual application product, according to a preferred embodiment of the present invention. Such as shown in FIG. 1, patch antennas 120 and 220 of the present invention are made of such as C260 brass, and are installed on a base board 100, wherein a coated ground plane 110 made of electrically conductive material is formed on the lower surface of the base board 100, and the coated ground plane 110 is used as the surface of grounding. The base board 100 can be a printed circuit board (PCB) made of fiberglass (FR4) material. The base board 100 has a RF device, and the RF device has an antenna output terminal (not shown) used for transmitting signals between the RF device and the antenna. The patch antenna 120 and the patch antenna 220 are completely identical, and the purpose for using two patch antennas is that: when one patch antenna receives or emits signals poorly, it can be substituted with the other one for performing the signal transmission. The patch antenna 120 is composed of a radiating metal plate 122, a metal supporting plate 132 and the metal fixed plate 142, while the patch antenna 220 is composed of a radiating metal plate 222, a metal supporting plate 232 and the metal fixed plate 242, wherein the radiating metal plate 122 and the radiating metal plate 222 are round plates having an opening 124 and an opening 224 respectively. There is a predetermined distance between the coated ground plane 110 and the radiating metal plates 122 and 222.

The metal fixed plates 142 and 242 can be installed on the antenna output terminal (or the base board 100) by using, for example, the surface mount technology, and the orientation of the metal fixed plate 142 and that of the metal fixed plate 242 can be different in accordance with the requirements of the actual mechanism design of housing 150. After the base board 100 is combined with the housing 150 of the application product, the patch antenna 120 and the patch antenna 220 are located inside a convex hollow portion 152 (its height can be, for example, about 7.49 mm), wherein the distance between the radiating metal plates 122/222 and the top of the housing 150 can significantly influence the radiation pattern of the antenna. Hence, such as shown in FIG. 1, one of the features of the present invention is that the patch antennas can match very well with the mechanism of the housing 150 of the application product, wherein the application product can be, for example, IEEE802.11a cardbus card or an access point. The material of the housing 150 can be, for example, amorphous polycarbonate/acrylonitride-butadiene-styreneterpolymer (PC/ABS). Since the patch antenna 120 and the patch antenna 220 are completely identical, hereinafter, only the patch antenna 120 is used for explaining the structure of the patch antenna of the present invention.

Figure 2:
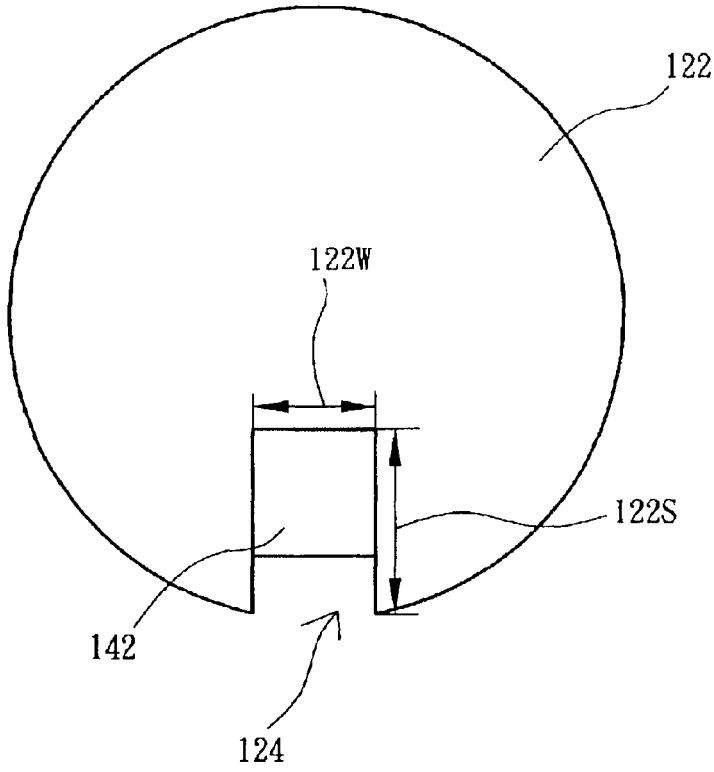
FIG. 2 is a schematic diagram showing the top view of the patch antenna, according to the preferred embodiment of the present invention.
Figure 3:
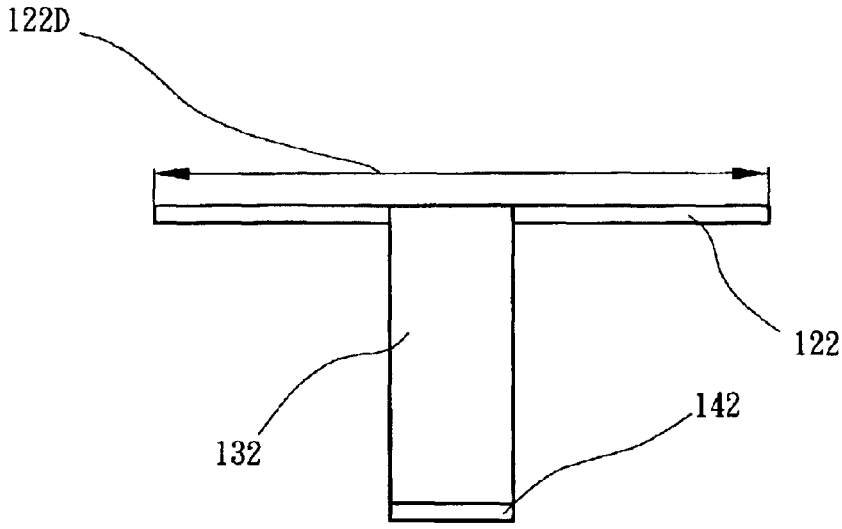
FIG. 3 is a schematic diagram showing the front view of the patch antenna, according to the preferred embodiment of the present invention.
Figure 4:
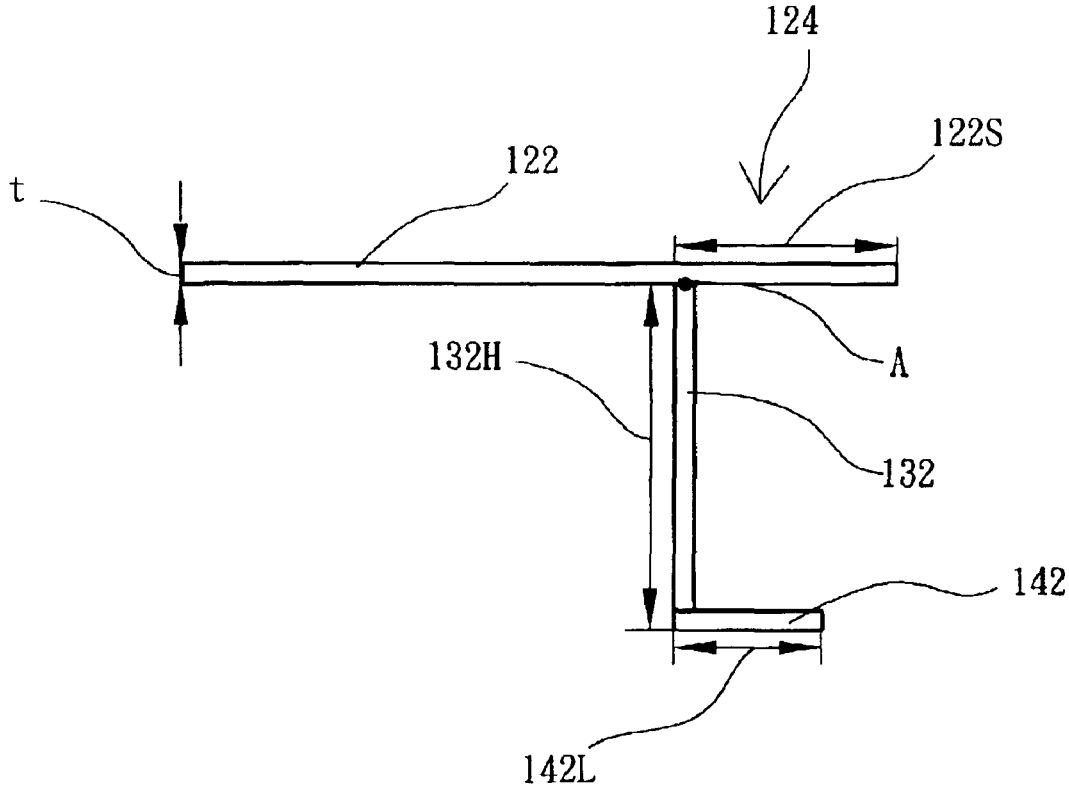
FIG. 4 is a schematic diagram showing the side view of the patch antenna, according to the preferred embodiment of the present invention.

Referring to FIG. 2, FIG. 3 and FIG. 4, FIG. 2, FIG. 3 and FIG. 4 are schematic diagrams respectively showing the top view, the front view and the side view of the patch antenna, according to the preferred embodiment of the present invention. Such as shown in FIG. 2, the radiating metal plate 122 has a stripe-shaped opening 124, and the metal fixed plate 142 is located right below the opening 124. The opening width 122W of the opening 124 can be, for example, about 1.75 mm, and the opening length 122S thereof can be, for example, about 2.7 mm. Such as shown in FIG. 3, the radiating plate diameter 122D of the radiating metal plate 122 can be, for example, about 8.66 mm. One end of the metal supporting plate 132 is connected to the side marked with the opening width 122W of the opening 124, i.e. to the side that is not parallel to the other sides of the opening 124. The other end of the metal supporting plate 132 is connected to one end of the metal fixed plate 142. Such as shown in FIG. 4, a feeding point A is located on the connection area of the metal supporting plate 132 and the opening 124 of the radiating metal plate 122. The supporting plate length 132H of the metal supporting plate 132 can be, for example, about 4.2 mm, and the fixed plate length 142L of the metal fixed plate 142 can be, for example, about 1.8 mm, wherein the metal fixed plate 142 can be aligned with the opening 124, or in other different directions in accordance with the actual requirements. The thickness t of the patch antenna of the present invention can be, for example, about 0.25 mm.

Figure 5A:
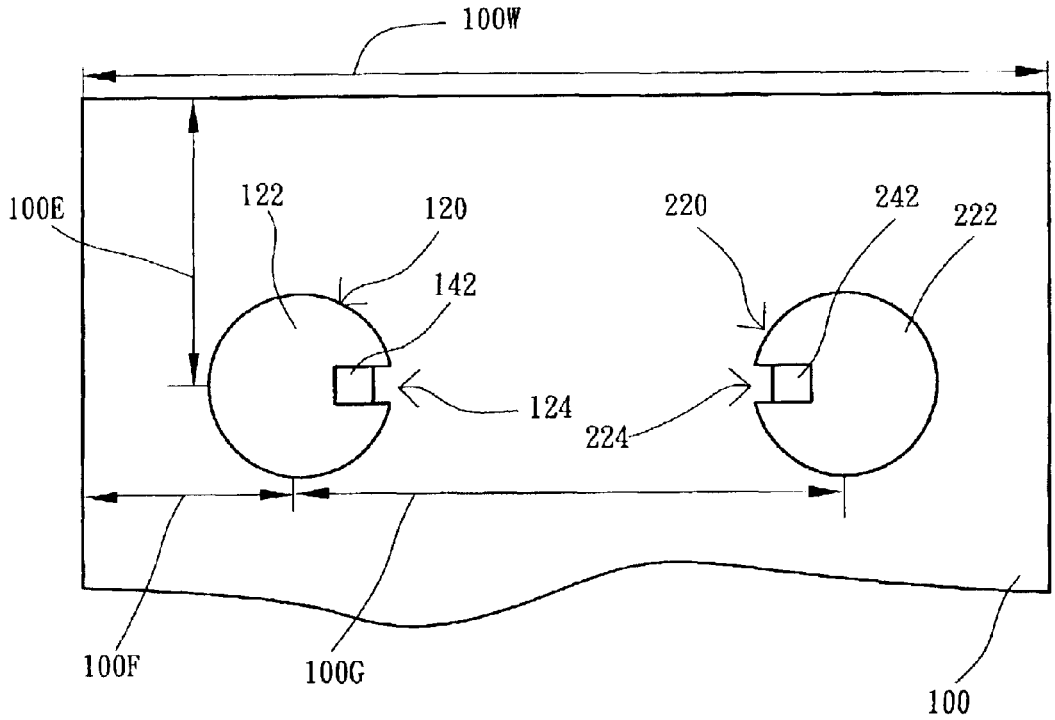
FIG. 5A, FIG. 5B and FIG. 5C are schematic diagrams respectively showing the antenna diversity arrangements of the patch antenna, according to the preferred embodiment of the present invention.
Figure 5B:
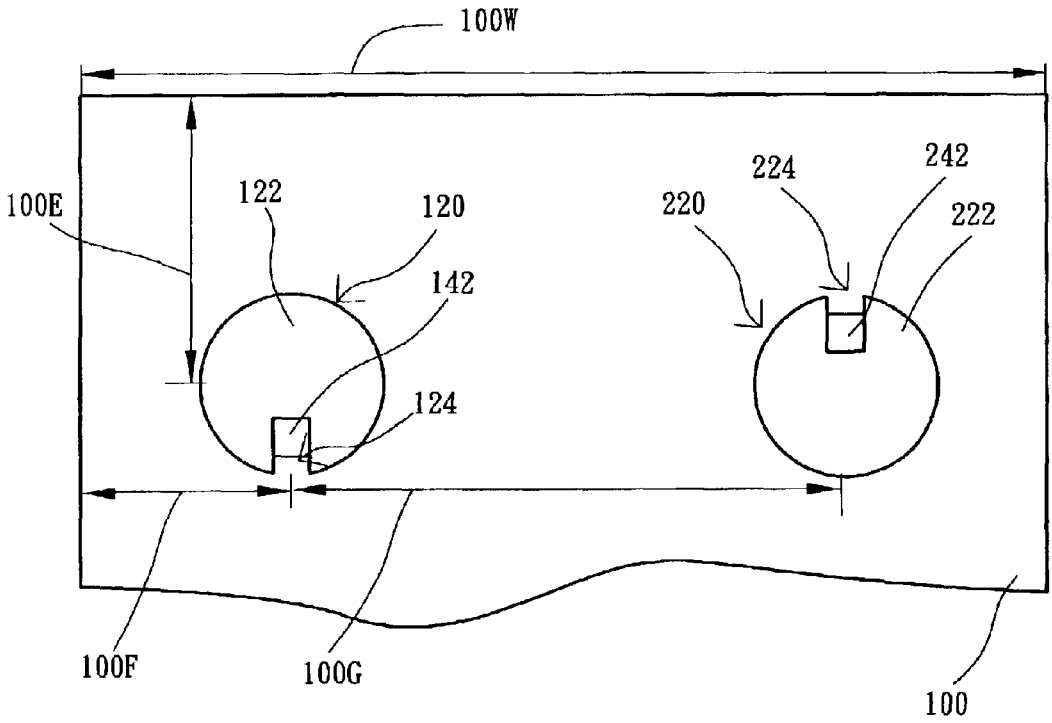
Figure 5C:
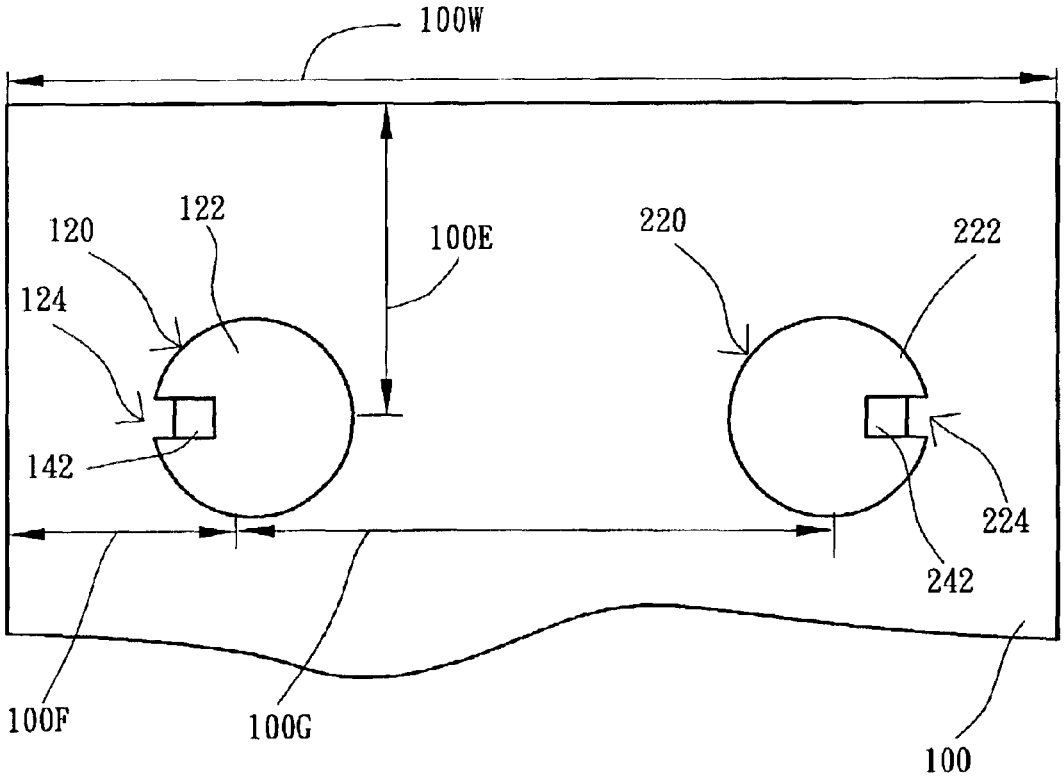

Further, the wireless network apparatus of the present invention can utilize the arrangement of the antenna diversity to obtain better antenna performance. Referring to FIG. 5A, FIG. 5B and FIG. 5C, FIG. 5A, FIG. 5B and FIG. 5C are schematic diagrams respectively showing the antenna diversity arrangements of the patch antenna, according to the preferred embodiment of the present invention. The base board width 100W of the base board 100 can be, for example, about 43 mm; the distance 100E, between the patch antennas 120/220 and the side marked with the base board width 100W of the base board 100, is for example about 14.83 mm; the distance 100F, between each of the patch antennas 120/220 and each of the other two sides of the base board respectively, is for example about 8.74 mm; and the distance 100G, between the patch antenna 120 and the patch antenna 120, is for example about 24.23 mm. The opening 124 and the opening 224 can face to each other, i.e. both openings face inwards (such as shown in FIG. 5A); or the opening 124 and the opening 224 can face towards the opposite directions, i.e. the opening 124 faces downwards and the opening 224 faces upwards (such as shown in FIG. 5B), or the opening 124 and the opening 224 both face outwards (such as shown in FIG. 5C). Via the aforementioned various arrangements of the opening faces, the antenna features of the present invention, such as radiation pattern, etc., can be further promoted.

It is worthy to be noted that the locations, sizes and materials of each of the components mentioned above are merely stated for explanation, so that the present invention is not limited thereto.

After actual measurements, the patch antenna of the present invention is proved to have excellent antenna features, and can fully cover the bandwidth required by Industrial-Scientific-Medical (ISM) band, such as from 5.15 GHz to 5.35 GHz.

Figure 6A:
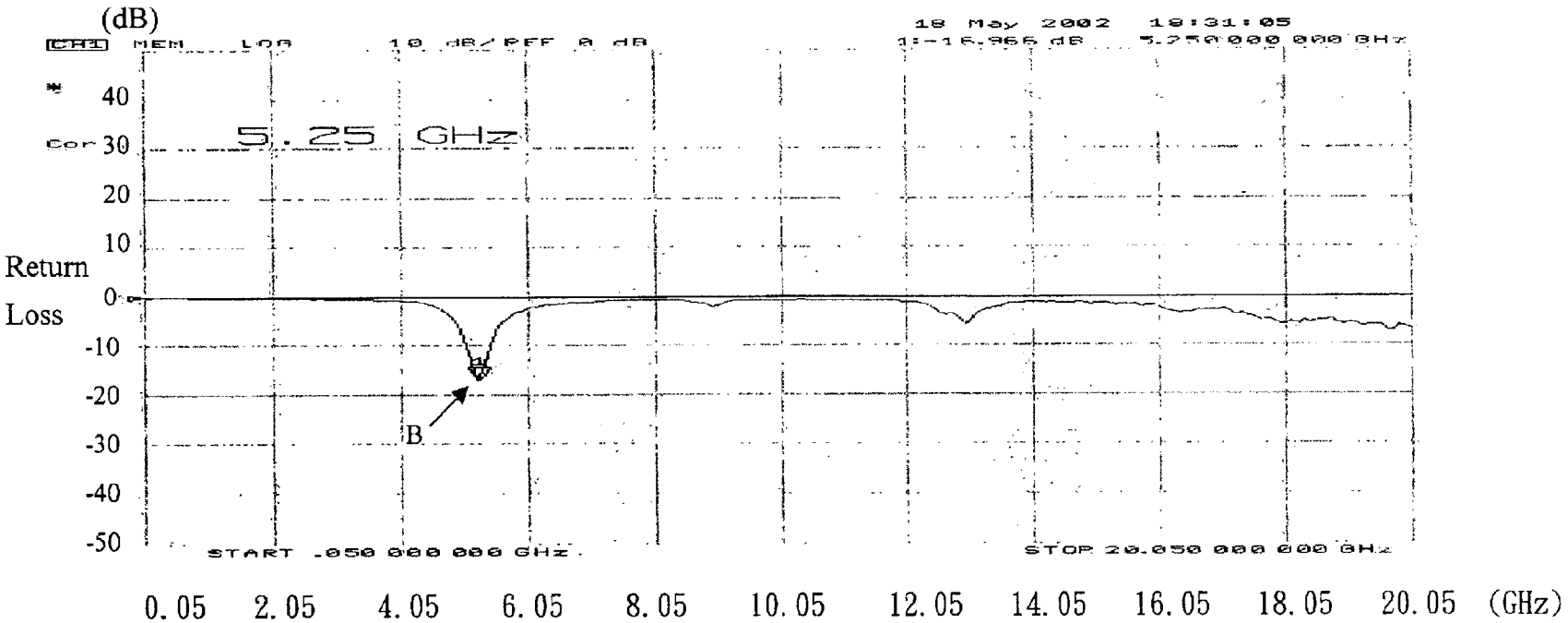
FIG. 6A and FIG. 6B are diagrams showing the measured result of return loss vs. frequency for the patch antenna of the preferred embodiment of the present invention.
Figure 6B:
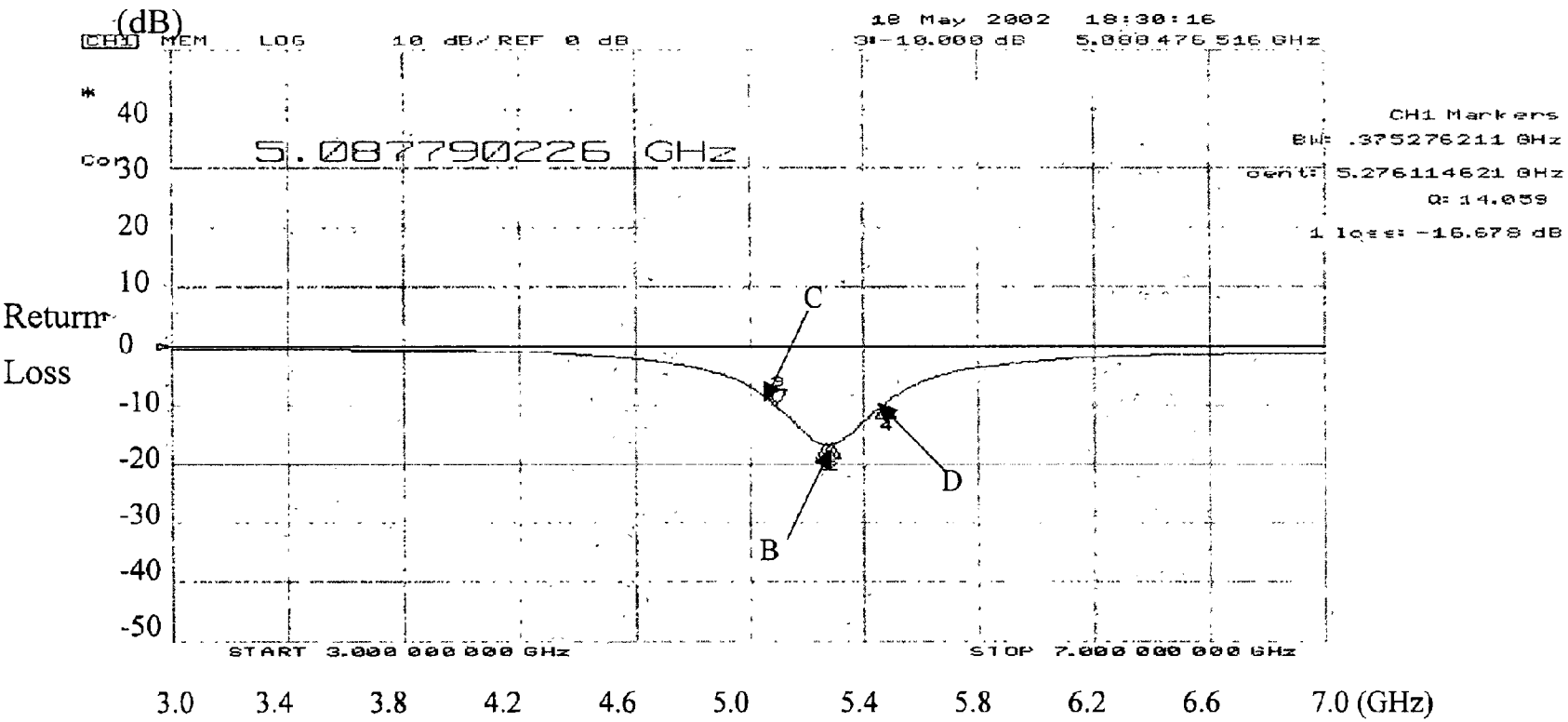

Referring FIG. 6A and FIG. 6B, FIG. 6A and FIG. 6B are diagrams showing the measured result of return loss vs. frequency for the patch antenna of the preferred embodiment of the present invention, wherein the frequency range shown in FIG. 6A is larger than that in FIG. 6B. Such as shown in FIG. 6A, the patch antenna of the present invention has smaller second harmonic in the neighborhood of about 10.5 GHz, so that EMI can be prevented. Such as shown in FIG. 6B, when the patch antenna of the present invention is operated at about 5.25 GHz (such as point B), if the operation bandwidth of the antenna is computed with −10 dB return loss, the operation bandwidth of the patch antenna of the present invention is the one between about 5.1 GHz (such as point C) and about 5.5 GHz (such as point D). Conservatively speaking, the operation bandwidth of the patch antenna of the present invention can be the one between about 5.1 GHz and about 5.35 GHz, i.e. the operation bandwidth can be larger than 200 MHz. Moreover, while being operated at about 5.25 GHz, the peak gain of the patch antenna of the present antenna is about 1.253 dB.

Figure 7A:
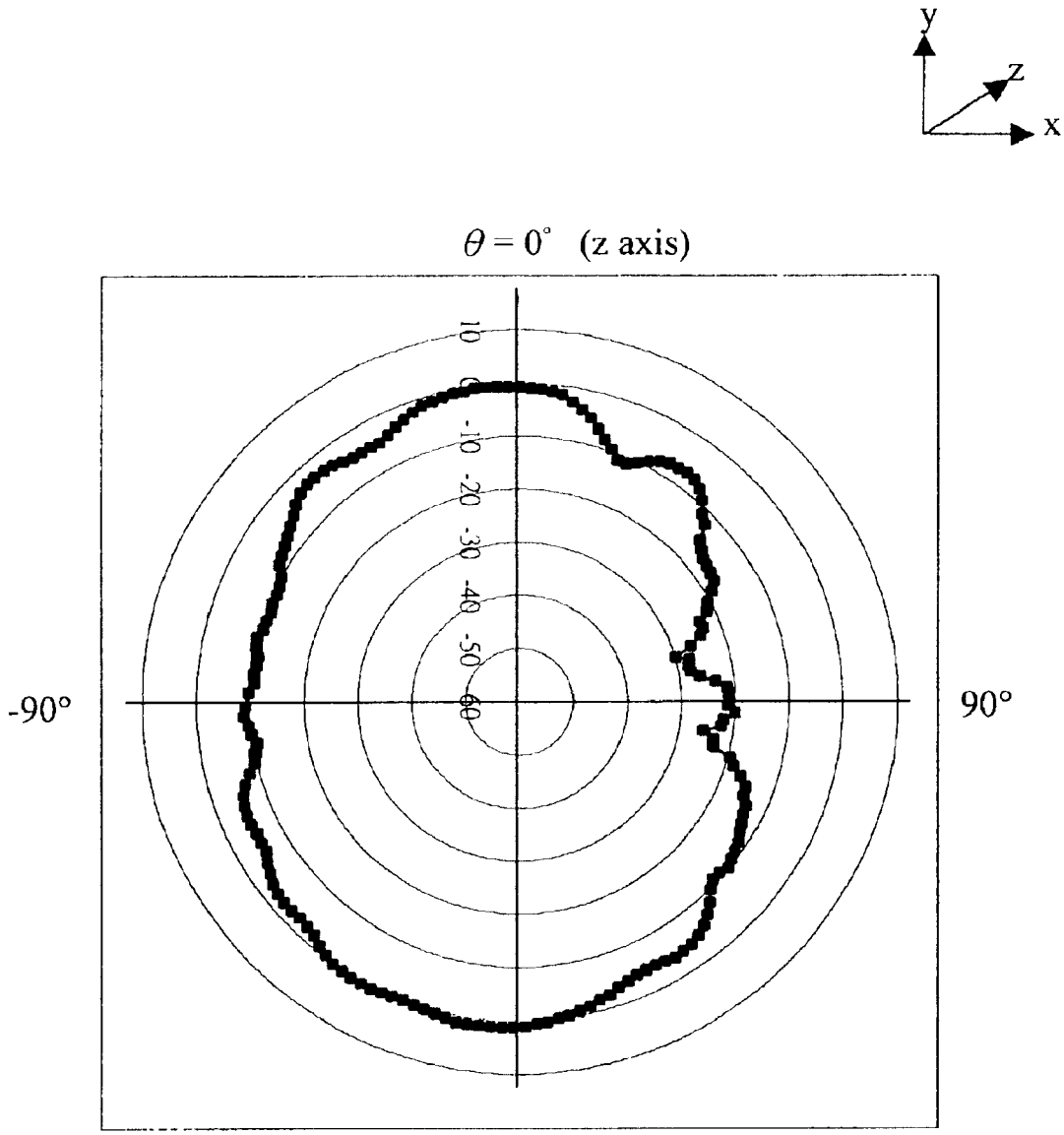
FIG. 7A is a diagram showing measured radiation pattern in x-z plane when the patch antenna of the preferred embodiment of the present invention is operated at 5.25 GHz.
Figure 7B:
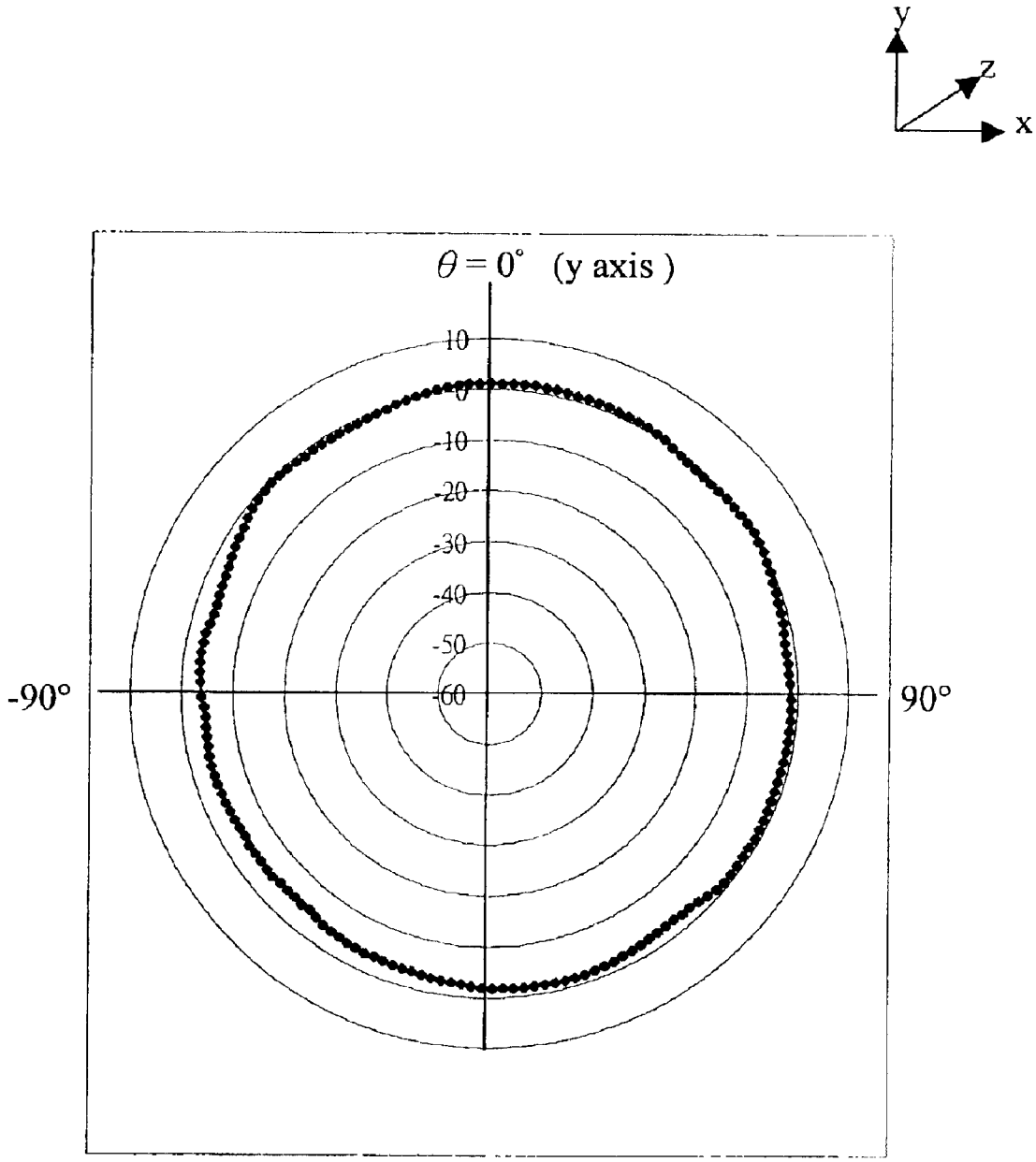
FIG. 7B is a diagram showing measured radiation pattern in x-y plane when the patch antenna of the preferred embodiment of the present invention is operated at 5.25 GHz.

Referring FIG. 7A and FIG. 7B, FIG. 7A is a diagram showing measured radiation pattern in x-z plane when the patch antenna of the preferred embodiment of the present invention is operated at 5.25 GHz; and FIG. 7B is a diagram showing measured radiation pattern in x-y plane when the patch antenna of the preferred embodiment of the present invention is operated at 5.25 GHz. It is known from FIG. 7B that a preferred embodiment of the present invention has an omni-directional antenna radiation pattern in x-y plane, and the radiation pattern in x-z plane as shown in FIG. 7A is also quite excellent.

The advantage of the present invention is to provide a patch antenna and the application systems thereof, wherein the patch antenna has the features of simple structure, small size, low profile and light weight, and further has small second harmonic that can avoid causing EMI. Additionally, the surface mount technology can be used to install the antenna on a base board, thus greatly reducing the production cost.

The other advantage of the present invention is to provide a patch antenna and the application systems thereof, wherein the arrangement of antenna diversity can be used to obtain better antenna performance.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A patch antenna, provided for covering the bandwidth utilized in Industrial-Scientific-Medical (ISM) band, comprising:

a base board;

a radiating metal plate, wherein said radiating metal plate is a round plate having a stripe-shaped opening, and is located at a predetermined distance from said base board, and said stripe-shaped opening is in a substantially rectangular form diametrically extending through the edge of said radiating metal plate, and said stripe-shaped opening is composed of two parallel sides and a connecting side vertically connecting said two parallel sides, and the average length of said stripe-shaped opening is shorter than the radius of said round plate, and said predetermined distance is longer than the average length of said stripe-shaped opening;

a metal supporting plate, wherein one end of said metal supporting plate is electrically connected to said connecting side of said stripe-shaped opening of said radiating metal plate and a feeding point is formed thereon; and a metal fixed plate, wherein one end of said metal fixed plate is electrically connected to the other end of said metal supporting plate, and said metal fixed plate is electrically installed on said base board.

2. The patch antenna of claim 1, wherein a coated ground plane is formed on a lower surface of said base board, and said coated ground plane is made of electrically conductive material, and said lower surface is opposite to the surface on which said metal fixed plate is installed.

3. The patch antenna of claim 1, wherein said base board is a printed circuit board (PCB).

4. The patch antenna of claim 1, wherein said base board is made of fiberglass (FR4).

5. The patch antenna of claim 1, wherein said patch antenna is made of brass.

6. The patch antenna of claim 1, wherein said metal fixed plate is installed on said base board by the surface mount technology (SMT).

7. The patch antenna of claim 1, further comprising:

a housing, having a convex hollow portion used for covering portion of said base board, wherein said patch antenna is located inside said convex hollow portion, and there is an designated distance between the top of said convex hollow portion and said radiating metal plate.

8. The patch antenna of claim 7, wherein said housing is made of amorphous polycarbonate/acrylonitride-butadiene-styreneterpolymer (PC/ABS).

9. A wireless network apparatus used in a wireless system for covering the bandwidth utilized in Industrial-Scientific-Medical (ISM) band, said wireless network apparatus comprising:

a base board, wherein said base board has a radio frequency (RF) device, and said radio frequency device has an antenna output terminal used for transmitting signals between said radio frequency device and said wireless system;

a first patch antenna, located on one end of said base board, wherein said first patch antenna comprises:

a first radiating metal plate, wherein said first radiating plate is a first round plate having a first stripe-shaped opening, and is located at said first predetermined distance from said base board, and said first stripe-shaped opening is in a substantially rectangular form diametrically extending through the edge of said first radiating metal plate, and said first stripe-shaped opening is composed of two first parallel sides and a first connecting side vertically connecting said two first parallel sides, and the average length of said first stripe-shaped opening is shorter than the radius of said first round plate, and said first predetermined distance is longer than the average length of said first stripe-shaped opening;

a first metal supporting plate, wherein one end of said first metal supporting plate is electrically connected to said first connecting side of said first stripe-shaped opening and a first feeding point is formed thereon; and a first metal fixed plate, wherein one end of said first metal fixed plate is electrically connected to the other end of said first supporting plate, and said first metal fixed plate is electrically installed on said antenna output terminal;

a second patch antenna, located on the same end where said first patch antenna is located, wherein said second patch antenna comprises:

a second radiating metal plate, wherein said second radiating metal plate is a second round plate having a second stripe-shaped opening, and is located at said second predetermined distance from said base board, and said second stripe-shaped opening is in a substantially rectangular form diametrically extending through the edge of said second radiating metal plate, and said second stripe-shaped opening is composed of two second parallel sides and a second connecting side vertically connecting said two second parallel sides, and the average length of said second stripe-shaped opening is shorter than the radius of said second round plate, and said second predetermined distance is longer than the average length of said second stripe-shaped opening;

a second metal supporting plate, wherein one end of said second metal supporting plate is electrically connected to said second connecting side of said second stripe-shaped opening and a second feeding point is formed thereon; and a second metal fixed plate, wherein one end of said second metal fixed plate is electrically connected to the other end of said second stripe-shaped supporting plate, and said second metal fixed plate is electrically installed on said antenna output terminal; and a housing, having a convex hollow portion used for covering a portion of said base board, wherein said first patch antenna and said second patch antenna are located inside said convex hollow portion, and there is an designated distance between the top of said convex hollow portion and said first radiating metal plate and said second radiating metal plate.

10. The wireless network apparatus of claim 9, wherein said first patch antenna is completely identical to said second patch antenna in size and shape.

11. The wireless network apparatus of claim 9, wherein said first stripe-shape opening and said second stripe-shape opening face to each other.

12. The wireless network apparatus of claim 9, wherein said first stripe-shape opening and said second stripe-shape opening towards the opposite directions.

13. The wireless network apparatus of claim 9, wherein said housing is made of amorphous polycarbonate/acrylonitride-butadiene-styreneterpolymer.

14. The wireless network apparatus of claim 9, wherein a coated ground plane is formed on a lower surface of said base board, and said coated ground plane is made of electrically conductive material, and said lower surface is opposite to the surface on which said first metal fixed plate is installed.

15. The wireless network apparatus of claim 9, wherein said base board is a printed circuit board.

16. The wireless network apparatus of claim 9, wherein said base board is made of fiberglass.

17. The wireless network apparatus of claim 9, wherein said first metal fixed plate and said second metal fixed plate are installed on said base board by the surface mount technology.

18. The wireless network apparatus of claim 9, wherein said first patch antenna and said second patch antenna are made of brass.

* * * * *